US011697984B2

(12) United States Patent
Bell et al.

(10) Patent No.: US 11,697,984 B2
(45) Date of Patent: Jul. 11, 2023

(54) SYSTEM AND PROCESS FOR PRODUCING DILUENT FROM DILBIT, TRANSPORTATION, AND TREATMENT OF HEAVY OIL

(71) Applicant: Cenovus Energy Inc., Calgary (CA)

(72) Inventors: Kelly Margaret Bell, Foothills (CA); Eusebio Palmisano, Calgary (CA); Michael Somerville, Calgary (CA); Michael Douglas Stillwell, Calgary (CA); Meghan Elizabeth Butler, Edmonton (CA); Dahai Dong, Calgary (CA); Steve Hicks, Calgary (CA); Timothy Michael Koskowich, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/535,639

(22) Filed: Nov. 25, 2021

(65) Prior Publication Data

US 2022/0170354 A1 Jun. 2, 2022

Related U.S. Application Data

(60) Provisional application No. 63/118,855, filed on Nov. 27, 2020.

(51) Int. Cl.

| | |
|---|---|
| ***C10G 1/00*** | (2006.01) |
| ***E21B 43/24*** | (2006.01) |
| ***C10G 33/06*** | (2006.01) |

(52) U.S. Cl.

CPC ..... *E21B 43/2408* (2013.01); *C10G 1/002* (2013.01); *C10G 33/06* (2013.01)

(58) Field of Classification Search

CPC ..... E21B 43/2408; C10G 1/002; C10G 33/06

See application file for complete search history.

(56) References Cited

U.S. PATENT DOCUMENTS

2017/0175004 A1* 6/2017 Papavassiliou ..... C10G 9/002
2018/0291293 A1* 10/2018 Gonzalez ..... C10G 7/02

FOREIGN PATENT DOCUMENTS

CA 2550406 A1 12/2007
CA 2896613 A1 6/2014
(Continued)

OTHER PUBLICATIONS

Santos et al., "An Overview of Heavy Oil Properties and Its Recovery and Transportation Methods," Brazilian Journal of Chemical Engineering , Jul.-Sep. 2014, vol. 31 (3), pp. 571-590.

*Primary Examiner* — Ellen M McAvoy
*Assistant Examiner* — Chantel L Graham
(74) *Attorney, Agent, or Firm* — Gordon & Jacobson, P.C.

(57) ABSTRACT

A process for producing diluent for use in a hydrocarbon recovery process includes heating a dilbit feed stream comprising hydrocarbons produced from a hydrocarbon reservoir and an added diluent, to a temperature of 350° C. or less, fractionating the dilbit feed stream after heating to produce a light fraction and a heavy fraction, the light fraction comprising the diluent, additional light hydrocarbons, and sour water, separating the sour water from a remainder of the light fraction, and stabilizing the remainder of the light fraction to provide recovered diluent and cooling the recovered diluent. A volume of the recovered diluent is greater than a volume of the added diluent.

20 Claims, 9 Drawing Sheets

(56) References Cited

FOREIGN PATENT DOCUMENTS

| | | | |
|---|---|---|---|
| CA | 2840654 | A1 | 10/2014 |
| CA | 2592392 | C | 12/2015 |
| CA | 2643893 | C | 1/2016 |
| CA | 2982789 | C | 12/2018 |
| CA | 2995532 | C | 9/2019 |
| CA | 3048343 | C | 1/2021 |
| WO | 9810036 | A1 | 3/1998 |
| WO | 2011087349 | A1 | 7/2011 |
| WO | 2011087350 | A1 | 7/2011 |
| WO | 2012108836 | A1 | 8/2012 |
| WO | 2014137230 | A2 | 9/2014 |
| WO | 2015167868 | A1 | 11/2015 |

* cited by examiner

SYSTEM AND PROCESS FOR PRODUCING DILUENT FROM DILBIT, TRANSPORTATION, AND TREATMENT OF HEAVY OIL

TECHNICAL FIELD

The present invention relates to production, transportation, and treatment of bitumen.

BACKGROUND

Extensive deposits of hydrocarbons exist around the world. Reservoirs of such deposits may be referred to as reservoirs of light oil, medium oil, heavy oil, extra-heavy oil, bitumen, or oil sands, and include large oil deposits in Alberta, Canada. It is common practice to segregate petroleum substances into categories that may be based on oil characteristics, for example, viscosity, density, American Petroleum Institute gravity (°API), or a combination thereof. For example, light oil may be defined as having an °API≥31, medium oil as having an °API≥22 and <31, heavy oil as having an °API≥10 and <22 and extra-heavy oil as having an °API≤10 (see Santos, R. G., et al. *Braz. J. Chem. Eng. Vol.* 31, No. 03, pp. 571-590). Although these terms are in common use, references to different types of oil represent categories of convenience, and there is a continuum of properties between light oil, medium oil, heavy oil, extra-heavy oil, and bitumen. Accordingly, references to such types of oil herein include the continuum of such substances, and do not imply the existence of some fixed and universally recognized boundary between the substances.

One thermal method of recovering viscous hydrocarbons in the form of bitumen, also referred to as oil sands, is known as steam-assisted gravity drainage (SAGD). In the SAGD process, pressurized steam is delivered through an upper, horizontal, injection well, also referred to as an injector, into a viscous hydrocarbon reservoir while hydrocarbons are produced from a lower, generally parallel, horizontal, production well, also referred to as a producer, that is near the injection well and is vertically spaced from the injection well. The injection and production wells are situated in the lower portion of the reservoir, with the producer located close to the base of the hydrocarbon reservoir to collect the hydrocarbons that flow toward the base of the reservoir.

The injected steam during SAGD initially mobilizes the hydrocarbons to create a steam chamber in the reservoir around and above the horizontal injection well. The term steam chamber in the context of a SAGD operation is utilized to refer to the volume of the reservoir that is heated to the steam saturation temperature with injected steam, and from which mobilized oil has at least partially drained and been replaced with steam vapor. As the steam chamber expands, viscous hydrocarbons in the reservoir and water originally present in the reservoir are heated and mobilized and move with aqueous condensate, under the effect of gravity, toward the bottom of the steam chamber. The hydrocarbons, the water originally present, and the aqueous condensate are typically referred to collectively as emulsion. The emulsion accumulates and is collected and produced from the production well.

The produced emulsion is treated to separate oil for sales and produced water. One approach to treating the emulsion is to add a lighter petroleum product referred to as diluent to enable treating by gravity separation. The diluent is mixed with the bitumen to yield a generally homogenous product that is lighter than water. The mix of diluent and bitumen may be referred to as dilbit. Additional diluent is added to the mix to reduce the blend viscosity to facilitate pipeline transport.

For pipeline transport, a blend viscosity of about 350 to 380 cSt is specified at a specific seasonal reference temperature. This translates to pipeline blends containing between about 25 and 32 volume % diluent depending on diluent and bitumen characteristics and the pipeline reference temperature, which, for example, may vary from 7.5° C. in February to 18.5° C. in September. At lower temperatures in colder months, a higher diluent content is utilized for pipeline transport from Alberta Oil Sands Facilities to refineries in the United States Gulf Coast.

The diluent is costly in the overall process. The diluent is separated out at the destination and returned by pipeline back to the origin location.

Improvements in handling and transportation of hydrocarbons are desirable.

SUMMARY

According to an aspect of an embodiment, there is provided a process for producing diluent for use in hydrocarbon recovery. The process includes heating a dilbit feed stream comprising hydrocarbons produced from a hydrocarbon reservoir and an added diluent, to a temperature of 350° C. or less, fractionating the dilbit feed stream after heating to produce a light fraction and a heavy fraction, the light fraction comprising the diluent, additional light hydrocarbons, and sour water, separating the sour water from a remainder of the light fraction, and stabilizing the remainder of the light fraction to provide recovered diluent and cooling the recovered diluent. A volume of the recovered diluent is greater than a volume of the added diluent.

Fractionating the dilbit feed stream may include feeding the dilbit feed stream after heating, to an upper portion of a diluent recovery unit.

Fractionating the dilbit feed stream may include introducing a stripping steam below a location at which the dilbit feed stream is introduced to the diluent recovery unit. The dilbit feed stream may be introduced to a flash vessel prior to heating to provide an overhead from the flash vessel and liquids, and heating the dilbit feed stream and fractionating may include heating the liquids from the flash vessel and fractionating the liquids. Gas from an overhead of the flash vessel may be introduced into the diluent recovery unit, between the location at which the dilbit feed stream is introduced and a location at which the stripping steam is introduced.

The light fraction may be cooled prior to separating the sour water.

The process may include condensing overhead gases from stabilizing, separating out remaining produced gas, and utilizing the remaining produced gas as fuel in the heating of the dilbit feed stream.

The recovered diluent from stabilizing may be cooled for use in hydrocarbon transport.

The heat from the heavy fraction after fractionating may be recovered. The heavy fraction may be loaded to a railcar for transportation. The heavy fraction has an °API of less than 10. The heavy fraction may have an °API of less than 8.0.

According to another aspect of an embodiment, a system is provided for producing diluent for use in a hydrocarbon recovery process. The system includes a heater for heating a dilbit feed stream including hydrocarbons produced from a hydrocarbon reservoir and an added diluent, to a temperature of 350° C. or less, a diluent recovery unit for fractionating the dilbit feed stream after heating to produce a light fraction and a heavy fraction, the light fraction comprising the diluent, additional light hydrocarbons, and sour water, a separator for separating the sour water from a remainder of the light fraction, and a stabilizer for stabilizing the remainder of the light fraction to provide recovered diluent and cooling the recovered diluent. A volume of the recovered diluent is greater than a volume of the added diluent.

The system may include a flash vessel for flashing the dilbit feed stream prior to introducing to the heater, to provide an overhead from the flash vessel and liquids.

A condenser may be utilized for condensing overhead gases from the stabilizer to separate out remaining produced gas. Produced gas from the condenser may be combined with natural gas and used as fuel in the heater. Produced gas may be treated for sulphur removal prior to use as heater fuel. A heavy fraction tank may store the heavy fraction prior to loading to a railcar. A diluent tank may be utilized to store diluent.

According to another aspect, a process for providing crude oil for refining may include blending the produced heavy fraction with a light tight oil to provide a blended crude having properties suitable for refining at a medium sour crude oil refinery.

The process may include blending a neatbit with a light tight oil to provide a blended crude having properties suitable for refining at a medium sour crude oil refinery. The neatbit may have a viscosity between 400-1000 cSt at 90° C. and °API between 7.8 and 10.0.

According to yet another aspect, a process for transporting diluent includes adding an aromatic hydrocarbon to the diluent, loading the mix of the aromatic hydrocarbon and diluent to a railcar having residual oil therein from hydrocarbon transportation, and transporting the diluent and the aromatic hydrocarbon in the railcar.

The aromatic hydrocarbon is added in an amount sufficient to inhibit asphaltene precipitation. The aromatic hydrocarbon may be added in an amount of about 2% by volume to about 6% by volume of the diluent, optionally in an amount of about 2% by volume to about 4% by volume of the diluent.

The aromatic hydrocarbon may include toluene or xylene.

The residual oil in the railcar may be 2 to 4 bbl of neatbit in the railcar.

BRIEF DESCRIPTION OF THE DRAWINGS

Embodiments of the present invention will be described, by way of example, with reference to the drawings and to the following description, in which.

DETAILED DESCRIPTION

Figure 1:
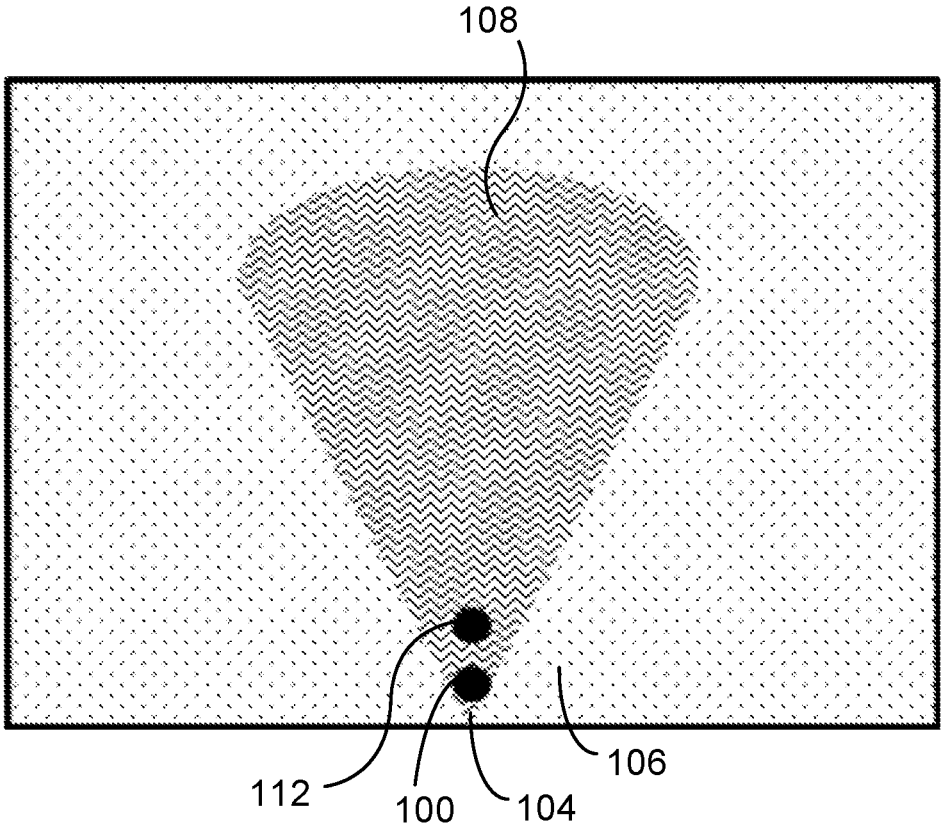
FIG. 1 is a sectional view through a reservoir, illustrating a SAGD well pair.

The disclosure generally relates to a process for producing diluent for use in a hydrocarbon recovery process. The process includes heating a dilbit feed stream including hydrocarbons produced from a hydrocarbon reservoir and an added diluent, to a temperature of 350° C. or less, and fractionating the dilbit feed stream after heating to produce a light fraction and a heavy fraction. The light fraction includes the diluent, additional light hydrocarbons, and sour water. The sour water is separated from a remainder of the light fraction and the remainder of the light fraction is stabilized to provide recovered diluent and the recovered diluent is cooled. The volume of the recovered diluent is greater than the volume of the added diluent to create the dilbit feed stream.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Reference is made herein to an injection well and a production well. The injection well and the production well may be physically separate wells. Alternatively, the production well and the injection well may be housed, at least partially, in a single physical wellbore, for example, a multilateral well. The production well and the injection well may be functionally independent components that are hydraulically isolated from each other and housed within a single physical wellbore.

Figure 2:
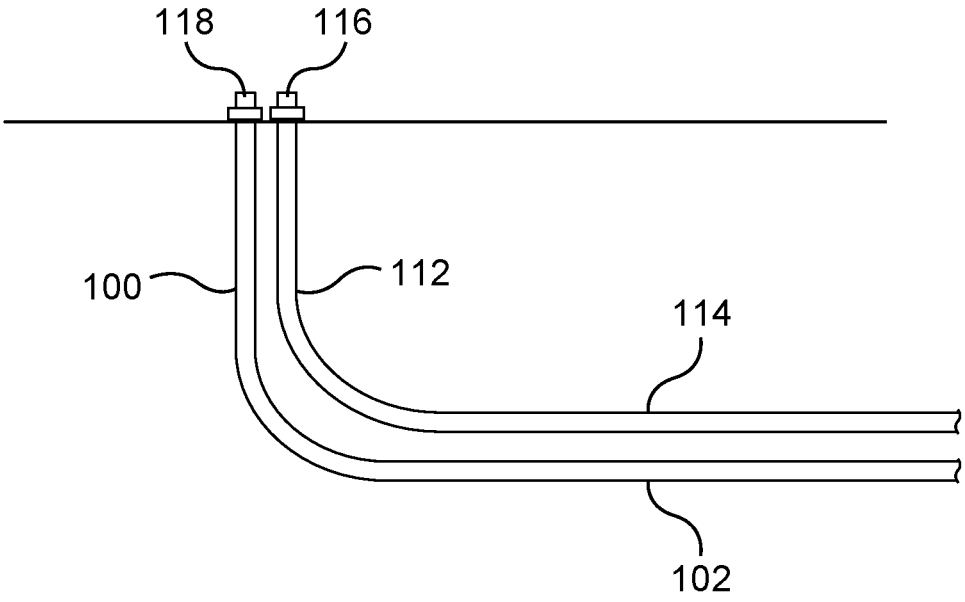
FIG. 2 is a sectional side view illustrating a SAGD well pair including an injection well and a production well.

As described above, a steam-assisted gravity drainage (SAGD) process may be utilized for mobilizing viscous hydrocarbons. In the SAGD process, a well pair, including a hydrocarbon production well and a steam injection well are utilized. An example of a well pair is illustrated in FIG. 1 and FIG. 2. The hydrocarbon production well 100 includes a generally horizontal portion 102 that extends near the base or bottom 104 of the hydrocarbon reservoir 106. An injection well 112 also includes a generally horizontal portion 114 that is disposed generally parallel to and is spaced vertically above the horizontal portion 102 of the hydrocarbon production well 100.

During production utilizing SAGD, steam is injected into the injection well head 116 and through the steam injection well 112 to mobilize the hydrocarbons and create a steam chamber 108 in the reservoir 106, around and above the generally horizontal portion 114.

Viscous hydrocarbons in the reservoir 106 are heated and mobilized and the mobilized hydrocarbons drain under the effects of gravity. Fluids, referred to as emulsion, including the mobilized hydrocarbons along with condensate, are collected in the generally horizontal portion 102 and are recovered via the hydrocarbon production well 100. Production may be carried out for any suitable period of time.

The produced emulsion is treated to separate bitumen from produced water. An added diluent is mixed with the bitumen to yield a product that is lighter than water. The mix of added diluent and bitumen may be referred to as dilbit.

Bitumen may be transported by rail without high diluent content. Removal of lighter diluent components reduces the vapour pressure and increases the flash point of the product, providing a less hazardous material for rail transport.

Figure 3:
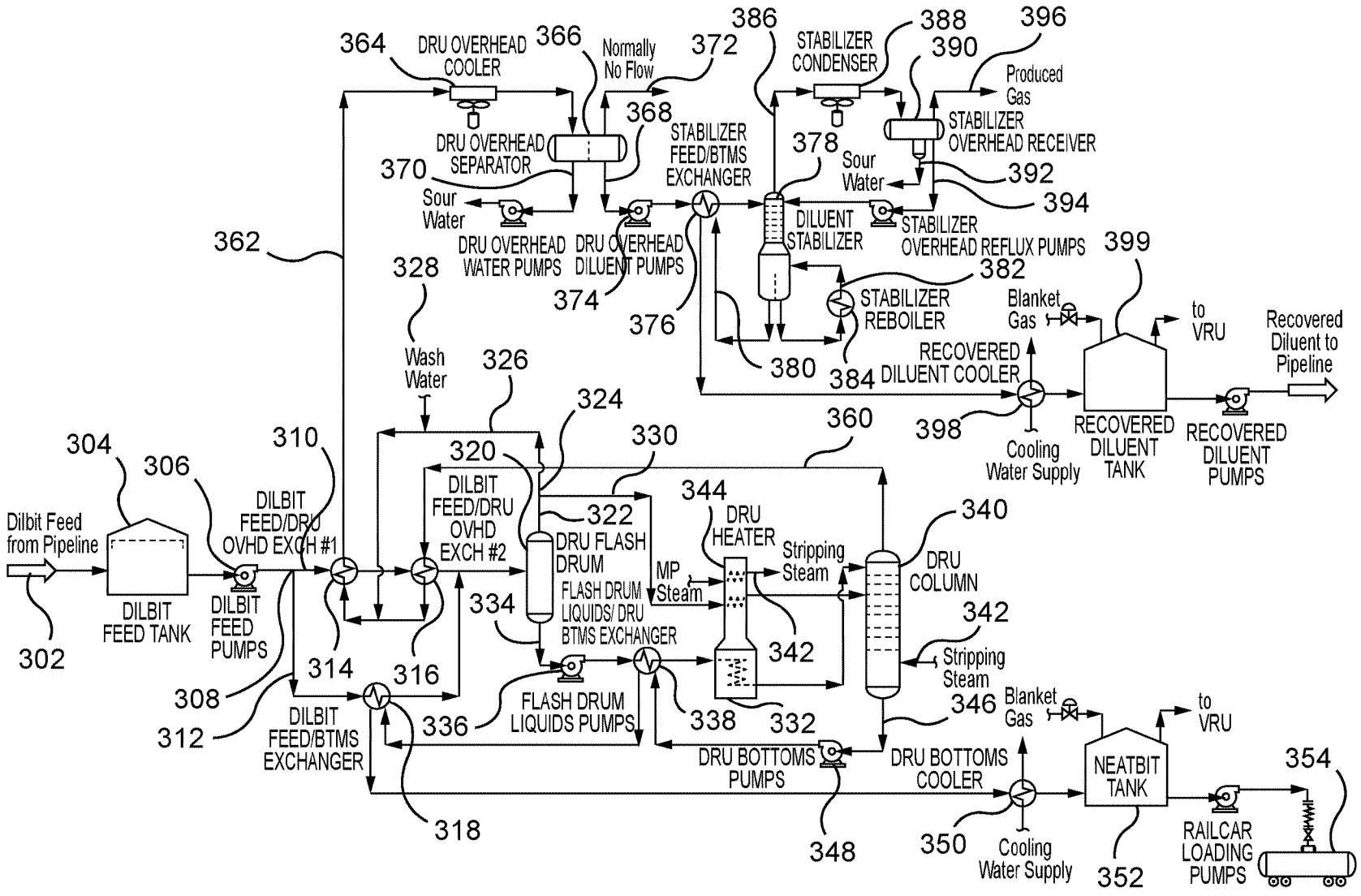
FIG. 3 is a simplified schematic view illustrating a system for producing diluent in accordance with an aspect of an embodiment.

Reference is made to FIG. 3 to describe a system for producing diluent in accordance with one particular embodiment. As illustrated in FIG. 3, a dilbit feed stream 302 may be transported to and stored in a dilbit feed tank 304. The dilbit feed stream 302 includes bitumen from a hydrocarbon production process and an added diluent mixed with the bitumen. The dilbit feed stream 302 is pumped from the dilbit feed tank 304 utilizing the pump 306 and is split using a splitter 308 into a first stream 310 and a second stream 312. The first stream 310 exchanges heat with vapours from a flash drum 320 and with a lighter fraction from a diluent recovery unit in heat exchangers 314, 316. The second stream 312 exchanges heat with a heavier fraction from the diluent recovery unit in a heat exchanger 318. Utilizing the heat exchangers 314, 316, 3158, the dilbit feed stream 302 is heated up to, for example, about 150° C.

The first stream 310 and the second stream 312 are combined again and fed as a combined stream at about 150° C. to the flash drum 320 referred to above. The flash drum 320 therefore receives the dilbit feed stream after heating to recover heat in the heat exchangers 314, 316, 318. The pressure is reduced in the flash drum 320 and vapours 322 are flashed off and split in a splitter 324. A first stream of the vapours 326, which includes most of the vapours, for example, between 60% and 70% of the vapours, from the flash drum 320 are joined with the lighter fraction from the diluent recovery unit for heat exchange, in the heat exchanger 314, with the first stream 310 of the dilbit feed stream to preheat the dilbit feed stream prior to introduction to the flash drum 320. A wash water 328 is introduced to the first stream of the vapours 326 to dilute acid and solubilize any corrosive salts in the first stream of the vapours 326 and the lighter fraction from the diluent recovery unit. The second stream of vapours 330, which includes a smaller fraction of the vapours than the first stream 326, is fed to a diluent recovery unit heater 332 for heating up to about 350° C. or less.

Bottom liquids 334 from the flash drum 320 are pumped, utilizing a pump 336, through a heat exchanger 338 for exchanging heat with the heavier fraction from the diluent recovery unit, thus further heating the bottom liquids 334 before introducing the bottom liquids 334 to the diluent recovery unit heater 332 in which the bottom liquids 334 are heated to about 350° C. or less. For example, the DRU heater may heat the bottom liquids to a temperature of about 250° C. to about 350° C., and, in the present embodiment, preferably to a temperature of about 290 C. The diluent recovery unit heater 332 may utilize gas removed from diluent during stabilizing of the diluent from the diluent recovery unit 340.

The bottom liquids 334, after heating in the diluent recovery unit heater 332, are introduced to the diluent recovery unit 340. The diluent recovery unit 340 may be a simple stripping unit without intermediate products. The diluent recovery unit 340 may be operated at a temperature between about 250° C. and 350° C. The diluent recovery unit 340 may include multiple trays, for example, 12 trays. The bottom liquids 334 from the flash drum 320 may be fed to a top portion, for example, to a top tray. The second stream of vapours 330 from the flash drum 320 may be utilized as a stripping gas and fed to an intermediate portion, for example, an intermediate tray of the diluent recovery unit 340. Stripping steam 342 is introduced in a bottom portion, for example, below a bottom tray of the diluent recovery unit 340. The stripping steam 342 and second stream of vapours 330 may be heated with hot flue gas in a convection section 344 of the diluent recovery unit heater 332 for efficiency. Reflux and rectification trays above the top tray to which the bottom liquids 334 are fed, are not utilized in the diluent recovery unit 340 in accordance with the present embodiment.

The heavier fraction 346 from the diluent recovery unit 340, which may be referred to as neatbit, exits the diluent recovery unit 340 at a temperature of about 260° C., for example, and is pumped via a pump 348, through the heat exchanger 318 for heat exchange with the second stream 312 of the dilbit feed stream 302 to preheat the second stream 312 of the dilbit feed stream 302 prior to introduction into the flash drum 320. The heavier fraction 346 is trim cooled, for example, to about 90° C., utilizing a cooling water 350 to provide a cooled neatbit with a viscosity of less than 400 cSt for rail loading, and an °API of less than 10, for example 7.8. The neatbit is stored in a neatbit tank 352 and may be loaded by pumping from the neatbit tank 352 to a railcar 354 for transport.

The lighter fraction 360 from the diluent recovery unit 340 may include $C_4$ to $C_{18}$ hydrocarbons from the dilbit feed stream 302. This lighter fraction 360 is cooled by heat exchange with the first stream 310 of the dilbit feed stream 302 in the heat exchanger 316. The lighter fraction 360 may be combined with the first stream of vapours 326 from the flash drum 320, which may include the wash water 328 utilized to dilute acid and solubilize corrosive salts. The combined stream 362 including the lighter fraction 360 and the first stream of vapours 326 from the flash drum 320 as well as wash water 328 is further cooled by heat exchange with the first stream 310 of the dilbit feed stream 302 in the heat exchanger 314.

The combined stream 362 is routed to a cooler 364, also referred to as an overhead cooler as the cooler 364 is utilized to cool the lighter fraction 360 from the overhead of the diluent recovery unit 340, which is included in the combined stream 362. The cooler 364 cools the entire combined stream 362 to a temperature of about 50° C. or less. For example, the cooler 364 cools the combined stream 362 to about 49° C.

After cooling, the combined stream 362 is sent to a separator 366, which separates diluent 368 from sour water 370 and produced gas 372. Very little, if any, produced gas 372 is generated and separated in the separator 366. The produced gas may be gasses dissolved in the dilbit feed stream 302 and a result of cracking of some of the hydrocarbons. The sour water 370 may be sent to a sour water stripper and recycled back into the process.

The diluent 368 that is separated out is then pumped, utilizing the diluent pump 374, through a heat exchanger 376 for heat exchange with recovered diluent 380 from a diluent stabilizer 378 to preheat the diluent 368 prior to introduction to the diluent stabilizer 378. The diluent stabilizer 378 is utilized to treat the diluent 368 to meet diluent pool specifications for $H_2S$ concentration, vapour pressure, and sulphur content. For example, the diluent stabilizer 378 may reduce the $H_2S$ concentration to 20 ppmw (in liquid phase), the vapour pressure to a DVPE of 103 kPa or less, and sulphur content to 0.5 wt % or less. Steam is utilized as a heat medium in a stabilizer reboiler 384. Liquid from the bottom tray of the diluent stabilizer 378 is reheated in the reboiler 384 and reintroduced into the diluent stabilizer 378 as stripping vapour 382.

Gases 386 from the top of the diluent stabilizer 378 are routed to a condenser 388 for air cooling and then to a three-phase separator 390, which separates out water 392, hydrocarbon liquids 394, and produced gas 396. The three-phase separator 390 may operate at a temperature of, for example, about 70° C. and a pressure of about 1100 kPag. The produced gas 396 may be utilized as fuel for the diluent recovery unit heater 332. The hydrocarbon liquids 394 are recycled back to the diluent stabilizer 378.

The recovered diluent 380 from the diluent stabilizer 378 is cooled in a diluent cooler 398, utilizing, for example, cooling water and then stored in a diluent tank 399. The recovered diluent 380 in the diluent tank 399 may be pumped out to a diluent pipeline, for example, or for rail transport as described herein. The volume of recovered diluent 378 is greater than the volume of diluent added to the bitumen to provide the dilbit feed stream 302. Thus, more diluent is produced utilizing the present process than diluent added to create the dilbit feed stream 302 for a given volume of bitumen. Diluent is therefore produced from the bitumen produced from the hydrocarbon recovery operation.

Figure 4:
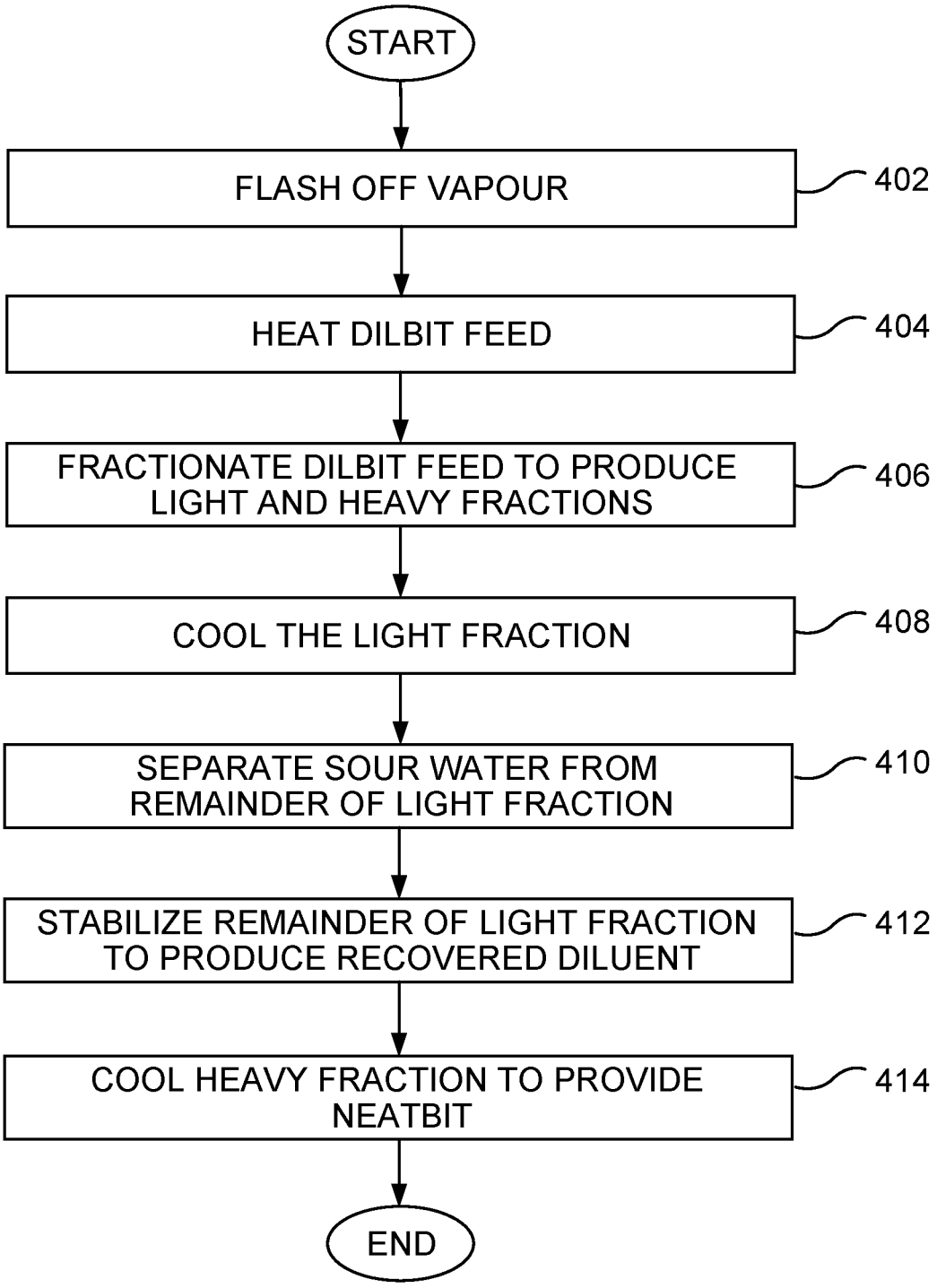
FIG. 4 is a flowchart showing a process for producing diluent in accordance with an aspect of an embodiment.

A flowchart illustrating a process for producing diluent and neatbit for rail transport is illustrated in FIG. 4. The system described with reference to FIG. 3 may be utilized to carry out the process of FIG. 4. The process is shown and described generally herein and may include additional or fewer elements than shown and described. Parts of the process may be performed in a different order than shown or described herein.

Vapours may optionally be flashed off the dilbit feed stream at 402. To flash off the vapours, the dilbit feed stream may be heated by heat exchange with, for example, products from a diluent recovery unit, followed by introduction to a flash drum for flashing off the vapours.

The dilbit feed stream is then heated in a diluent recovery unit heater at 404 to a temperature of 350° C. or less and the heated dilbit is fractionated to produce a light fraction and a heavy fraction at 406. As described with reference to FIG. 3, the heated dilbit may be fractionated in a diluent recovery column in which the dilbit is fed to a top portion within the column and stripping steam may be introduced to the column, below, for example, in a bottom portion.

The light fraction is cooled at 408 and sour water is separated from a remainder of the light fraction at 410. The remainder of the light fraction is then stabilized at 412 to meet diluent pool specifications for $H_2S$ concentration, vapour pressure, and sulphur content. As described with reference to FIG. 3, the remainder of the light fraction is stabilized to reduce the $H_2S$ concentration to 20 ppmw (in liquid phase), the vapour pressure to a DVPE of 103 kPa or less, and sulphur content to 0.5 wt % or less.

The heavy fraction is cooled at 412 to provide the cooled neatbit.

Figure 5:
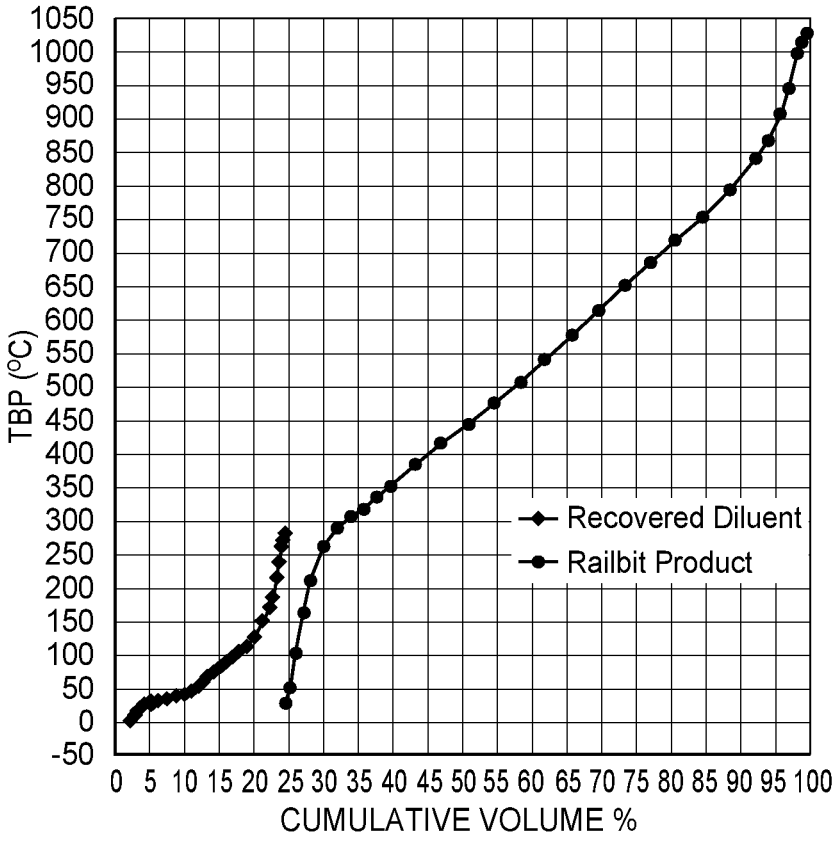
FIG. 5 and FIG. 6 are True Boiling Point (TBP) curves of products for diluent recovery, illustrating an increase in cumulative volume of recovered diluent utilizing the process according to an aspect of an embodiment.
Figure 6:
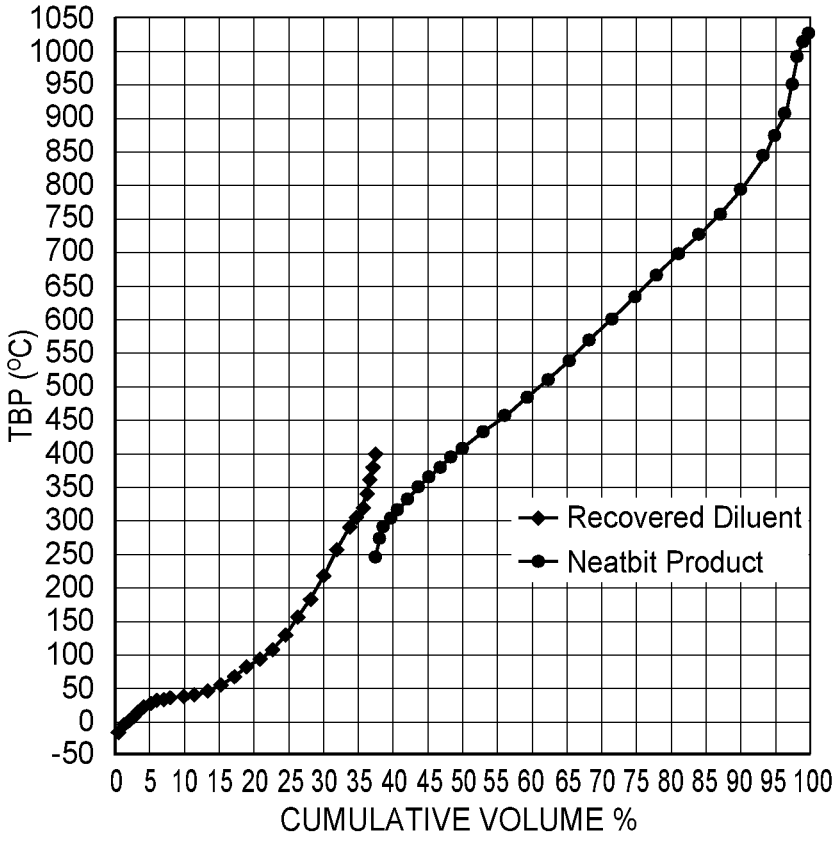

FIG. 5 and FIG. 6 are True Boiling Point (TBP) curves of products of the diluent recovery process. FIG. 5 illustrates the TBP curves of products utilizing a typical diluent recovery process. FIG. 6 illustrates the TBP curves of products utilizing a diluent recovery process according to an embodiment of the present application. As illustrated by comparing FIG. 6 to FIG. 5, the cumulative volume of recovered diluent utilizing the process according to an embodiment of the present application is greater than the cumulative volume of recovered diluent utilizing a typical diluent recovery process.

Figure 7:
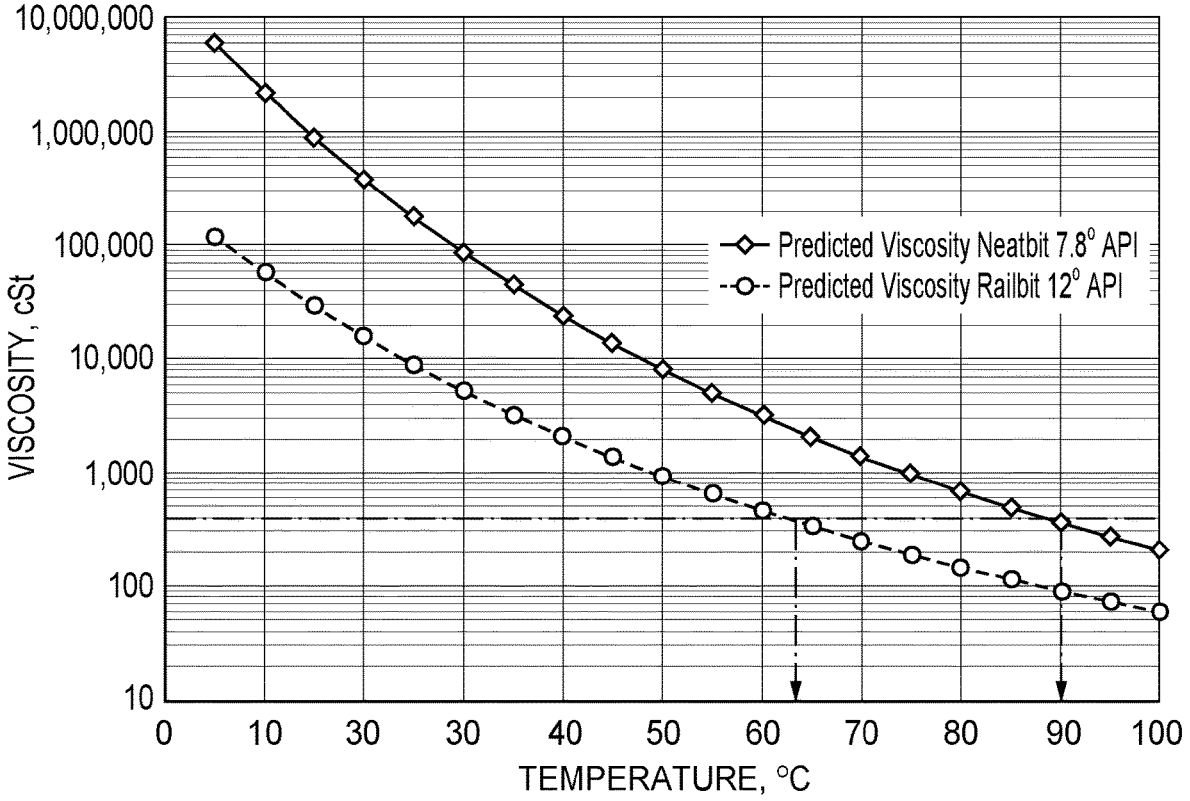
FIG. 7 is a graph of viscosity v. temperature and showing an increase in viscosity of the resulting bitumen utilizing the process according to an aspect of an embodiment.

FIG. 7 is a graph of viscosity v. temperature of the railbit produced utilizing a typical diluent recovery process, and the neatbit produced utilizing the process according to an embodiment of the present application. The effect of temperature on viscosity of the railbit is illustrated by the upper curve in the graph and the effect of temperature on viscosity of the neatbit is illustrated by the lower curve. The railbit has an °API of about 12 and the neatbit has an °API of less than 8. The neatbit may be stored at a higher temperature, for example, at about 90° C. compared to storage of railbit at about 65° C., to facilitate pumping of the neatbit to a railcar.

Figure 8:
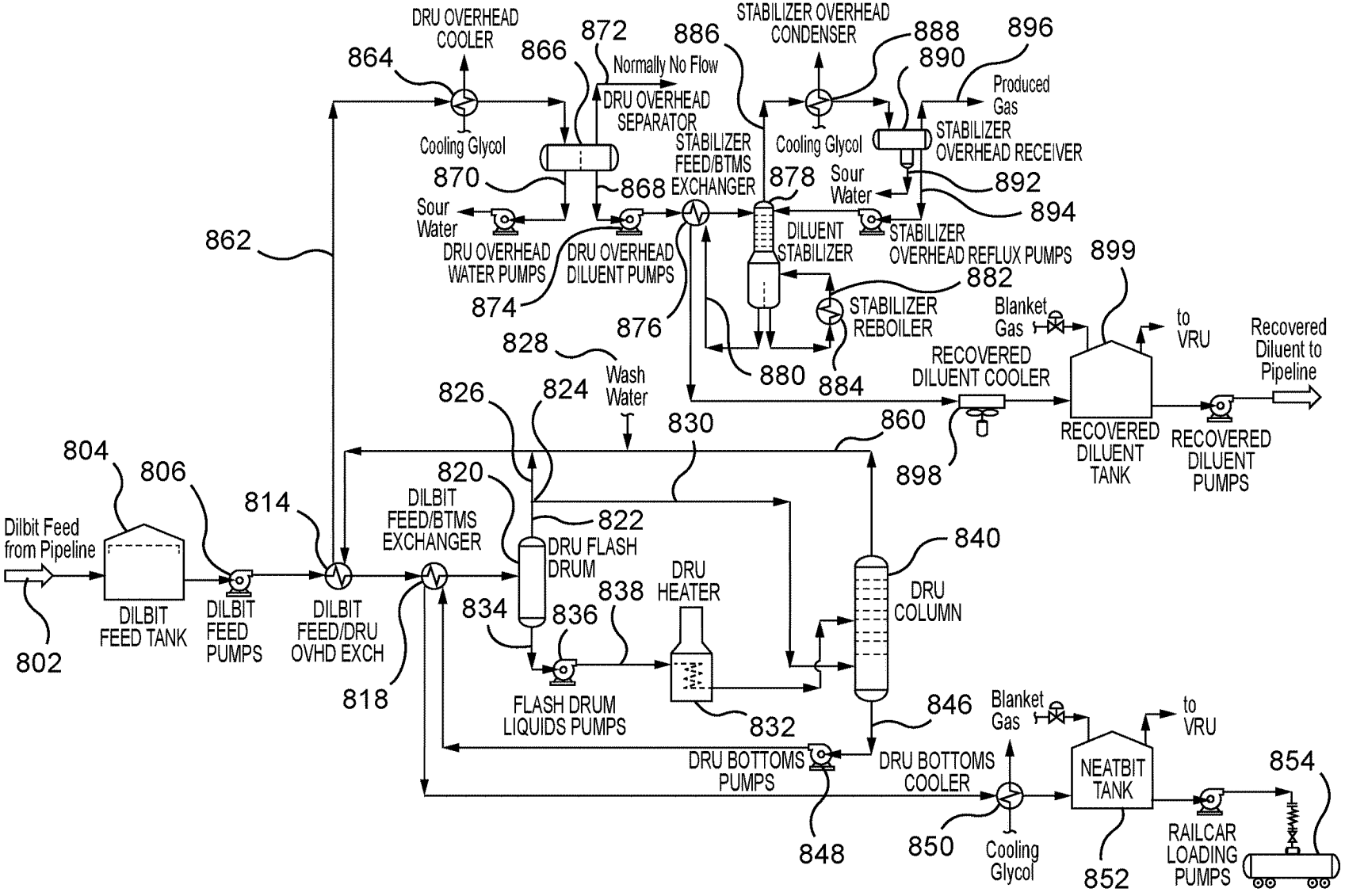
FIG. 8 is a simplified schematic view illustrating a system for producing diluent in accordance with an aspect of another embodiment.

FIG. 8 illustrates a system for producing diluent in accordance with another embodiment. The system illustrated in FIG. 8 includes many similar elements to those described with reference to FIG. 3. In the embodiment shown in FIG. 8, stripping steam is not utilized in the diluent recovery unit. The diluent recovery unit operates at temperature, for example, up to about 350° C. in this embodiment. In addition, heat exchange in the present embodiment differs from the heat exchange in the embodiment described with reference to FIG. 3.

The system illustrated in FIG. 8 and described herein may also be utilized to carry out the process of FIG. 4.

As illustrated in FIG. 8, the dilbit feed stream 802 may be transported to and stored in a dilbit feed tank 804. The dilbit feed stream 802 includes bitumen from a hydrocarbon production process and an added diluent mixed with the bitumen. The dilbit feed stream 802 is pumped from the dilbit feed tank 804 utilizing the pump 806 and exchanges heat with vapours from a flash drum 820 that are combined with a lighter fraction from a diluent recovery unit, in a heat exchanger 814. The dilbit stream then exchanges heat with a heavier fraction from the diluent recovery unit in a heat exchanger 818. Utilizing the heat exchangers 814, 818, the dilbit feed stream 802 is heated up to, for example, about 200° C.

The dilbit stream at, for example, about 200° C. is fed to the flash drum 820. The flash drum 820 therefore receives the dilbit feed stream after heating to recover heat in the heat exchangers 814, 818. The pressure is reduced in the flash drum 820 and vapours 822 are flashed off and split in a splitter 824. A first stream of the vapours 826, which includes most of the vapours, for example, between 60% and 70% of the vapours, from the flash drum 820 are joined with the lighter fraction from the diluent recovery unit for heat exchange, in the heat exchanger 814, with the dilbit stream to preheat the dilbit stream prior to introduction to the flash drum 820. A wash water 828 is introduced to the lighter fraction from the diluent recovery unit 860 which is combined with the first stream of the vapours 826. The second stream of vapours 830, which includes a smaller fraction of the vapours than the first stream 826, is fed to the diluent recovery unit 840.

Bottom liquids 834 from the flash drum 820 are pumped, utilizing a pump 836, into the diluent recovery unit heater 832 in which the bottom liquids 834 are heated to about 350° C. or less. For example, the diluent recovery unit heater may heat the bottom liquids to a temperature of about 250° C. to about 350° C. The bottom liquids may be heated to, for example, 340° C. The diluent recovery unit heater 832 may utilize gas removed from diluent during stabilizing of the diluent from the diluent recovery unit 840.

The bottom liquids 834, after heating in the diluent recovery unit heater 832, are introduced to the diluent recovery unit 840. The diluent recovery unit 840 may be a simple stripping unit without intermediate products. The diluent recovery unit 840 may be operated at a temperature between about 250° C. and 350° C. The diluent recovery unit 840 may include multiple trays. The bottom liquids 834 from the flash drum 820 may be fed to an intermediate portion, for example, to an intermediate tray. The second stream of vapours 830 from the flash drum 820 may be utilized as a stripping gas and fed to a lower portion, for example, lower tray of the diluent recovery unit 840.

The heavier fraction 846 from the diluent recovery unit 840, which may be referred to as neatbit, exits the diluent recovery unit 840 at a temperature of about 260° C., for example, and is pumped via a pump 848, through the heat exchanger 818 for heat exchange with the dilbit feed stream 802 to preheat the dilbit feed stream 802 prior to introduction into the flash drum 820. The heavier fraction 846 is cooled, for example, to about 90° C., utilizing a cooling glycol 850 to provide a cooled neatbit with a viscosity of less than 400 cSt for rail loading, and an °API of less than 10, for example 7.8. The neatbit is stored in a neatbit tank 852 and may be loaded by pumping from the neatbit tank 852 to a railcar 854 for transport.

The lighter fraction 860 from the diluent recovery unit 840 may include $C_4$ to $C_{18}$ hydrocarbons from the dilbit feed stream 802. This lighter fraction 860, the wash water 828 introduced and the first stream of vapours 826 are together cooled by heat exchange with dilbit feed stream 802 in the heat exchanger 814.

The combined stream 862 is routed to a cooler 864, also referred to as an overhead cooler that utilizes, for example, cooling glycol to cool the lighter fraction 860 from the overhead of the diluent recovery unit 840, which is included in the combined stream 862. The cooler 864 cools the entire combined stream 862 to a temperature of about 50° C. or less. For example, the cooler 864 cools the combined stream 862 to about 49° C.

After cooling, the combined stream 862 is sent to a separator 866, which separates diluent 868 from sour water 870 and produced gas 872. Very little, if any, produced gas 872 is generated and separated in the separator 866. The produced gas may be gasses dissolved in the dilbit feed stream 802 and a result of cracking of some of the hydrocarbons. The sour water 870 may be sent to a sour water stripper and recycled back into the process.

The diluent 868 that is separated out is then pumped, utilizing the diluent pump 874, through a heat exchanger 876 for heat exchange with recovered diluent 880 from a diluent stabilizer 878 to preheat the diluent 868 prior to introduction to the diluent stabilizer 878. The diluent stabilizer 878 is utilized to treat the diluent 868 to meet diluent pool specifications for $H_2S$ concentration, vapour pressure, and sulphur content. For example, the diluent stabilizer 878 may reduce the $H_2S$ concentration to 20 ppmw (in liquid phase), the vapour pressure to a DVPE of 103 kPa or less, and sulphur content to 0.5 wt % or less. Steam is utilized as a heat medium in a stabilizer reboiler 884. Liquid from the bottom tray of the diluent stabilizer 878 is reheated in the reboiler 884 and reintroduced into the diluent stabilizer 878 as stripping vapour 882.

Gases 886 from the top of the diluent stabilizer 878 are routed to a condenser 888 for cooling utilizing, for example, cooling glycol, and then to a three-phase separator 890, which separates out water 892, hydrocarbon liquids 894, and produced gas 896. The three-phase separator 890 may operate at a temperature of, for example, about 70° C. and a pressure of about 1100 kPag. The produced gas 896 may be combined with natural gas to fuel the diluent recovery unit heater 832. The produced gas 896 may be treated for sulphur removal prior to use in fueling the diluent recovery unit heater 832. The hydrocarbon liquids 894 are recycled back to the diluent stabilizer 878.

The recovered diluent 880 from the diluent stabilizer 878 is cooled in a diluent cooler 898, for example, by air cooling and then stored in a diluent tank 899. The recovered diluent 880 in the diluent tank 899 may be pumped out to a diluent pipeline, for example, or for rail transport as described herein. The volume of recovered diluent 878 is greater than the volume of diluent added to the bitumen to provide the dilbit feed stream 802. Thus, more diluent is produced utilizing the present process than diluent added to create the dilbit feed stream 802 for a given volume of bitumen. Diluent is therefore produced from the bitumen produced from the hydrocarbon recovery operation.

Figure 9:
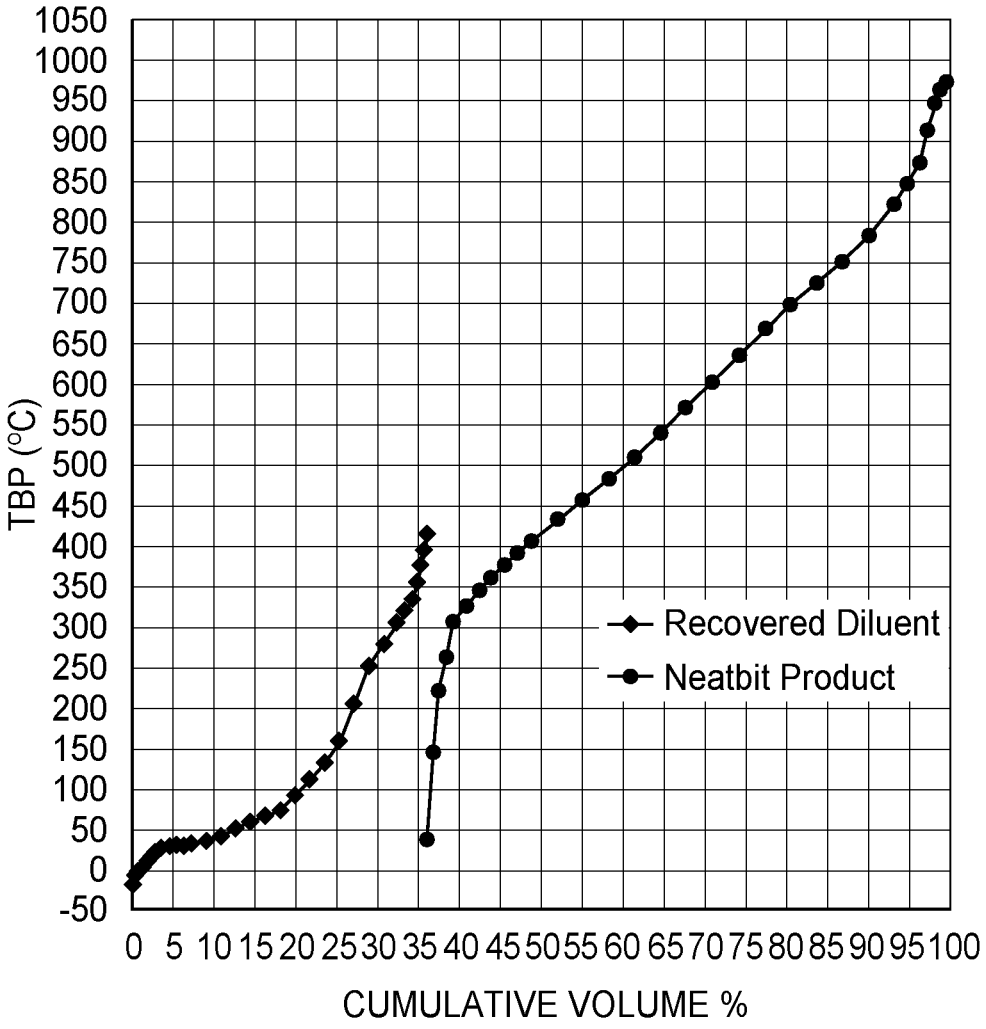
FIG. 9 is a True Boiling Point (TBP) curve of a products for diluent recovery, illustrating an increase in cumulative volume of recovered diluent utilizing the process according to an aspect of the embodiment of FIG. 8.

FIG. 9 is a True Boiling Point (TBP) curve of a product of the diluent recovery process according to the embodiment of FIG. 8. As illustrated by comparing FIG. 9 to FIG. 5, the cumulative volume of recovered diluent utilizing the process according to the embodiment of FIG. 8 is greater than the cumulative volume of recovered diluent utilizing a typical diluent recovery process.

Advantageously, more diluent is recovered from the dilbit feed stream than was utilized to create the dilbit feed stream in the embodiments described herein. Diluent is therefore produced from the bitumen produced from the hydrocarbon recovery operation. The process not only recovers diluent that was added but produces diluent that may be utilized for transporting other bitumen.

Figure 10:
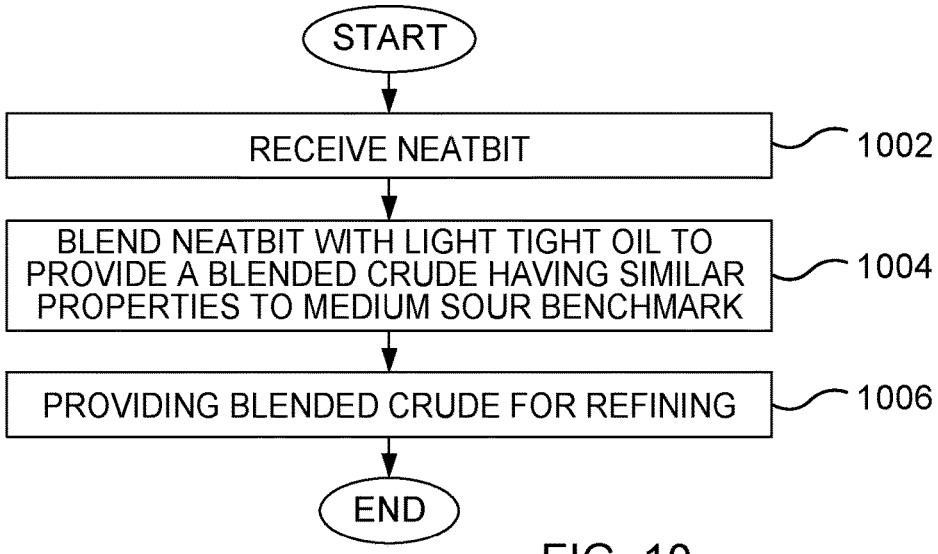
FIG. 10 is a flowchart showing a process for providing crude oil for refining in accordance with another aspect of an embodiment.

A flowchart illustrating a process for providing crude oil for refining is illustrated in FIG. 10. The process is shown and described generally herein and may include additional or fewer elements than shown and described. Parts of the process may be performed in a different order than shown or described herein.

Neatbit, such as the neatbit produced utilizing the system and method described above with reference to FIG. 3 or FIG. 8, and FIG. 4 may be transported by railcar, for example.

The neatbit has a viscosity between 400-1000 cSt at 90° C. and an °API between 7.8 and 10.0, facilitating pumping by a centrifugal pump and storage in a tank.

The boiling point of the neatbit may be about 290° C. and the neatbit includes a negligible fraction of naphtha (IBP-180° C.) measured as TBP distillation, and Kero (180-260° C.).

The neatbit is received at the destination at 1002. Heating may be utilized to unload the neatbit from the railcar at the destination. The neatbit is then blended, reducing viscosity. For example, the neatbit may be blended with heavy oil such as dilbit to provide a blend having a viscosity up to 1000 cST at 20° C. Alternatively, the neatbit may be blended with light tight oil at 1004, resulting in a blended crude that has an °API up to about 32. For example, the blended crude may have qualities and characteristics similar to medium sour crudes available from, for example, the Mars oilfield gas project or Southern Green Canyon in the United States Gulf Coast. The volume percentage of light tight oil that is blended with the neatbit to result in a blended crude with an °API up to about 32, such as a blended crude having characteristics similar to medium sour crude is dependent on the light tight oil. Table 1 below shows the volume percent of each light tight oil with neatbit to provide the blended crude.

TABLE 1

| API | Look-alike blend | West Texas Inter-mediate | Nederland Extra Light | Louisiana Sweet | Eagle Ford | Bakken | Conden-sate |
|---|---|---|---|---|---|---|---|
| 30 | Mars/ SGC | 70% | 61% | 76% | 63% | 68% | 42% |

The blended crude is then provided to the refinery at 1006 for refining.

Figure 11:
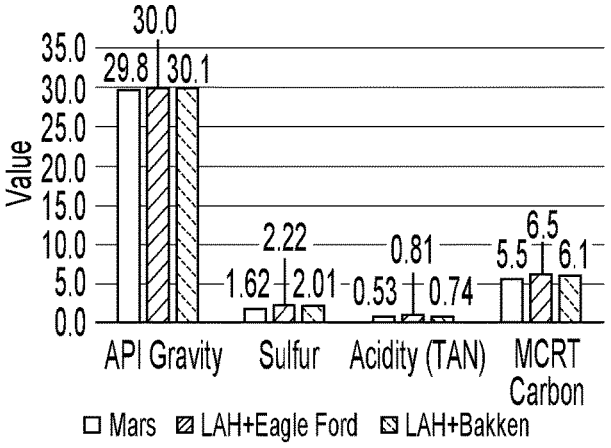
FIG. 11 and FIG. 12 show comparisons of medium sour crudes available from the Mars oilfield gas project with blended crudes in accordance with an aspect of an embodiment.
Figure 12:
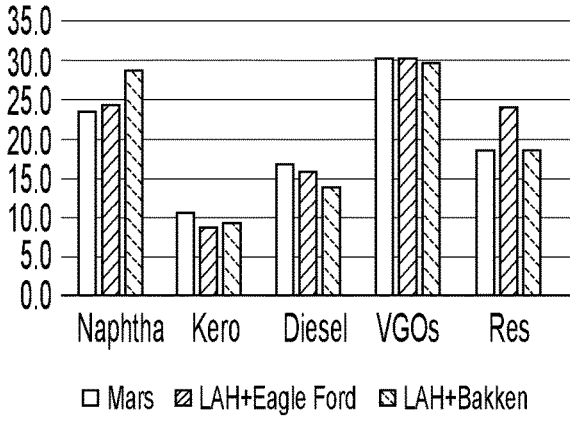

FIG. 11 and FIG. 12 show comparisons of medium sour crudes available from the Mars oilfield gas project with blended crudes utilizing light tight oil from Eagle Ford and utilizing light tight oil from Bakken with the neatbit.

Figure 13:
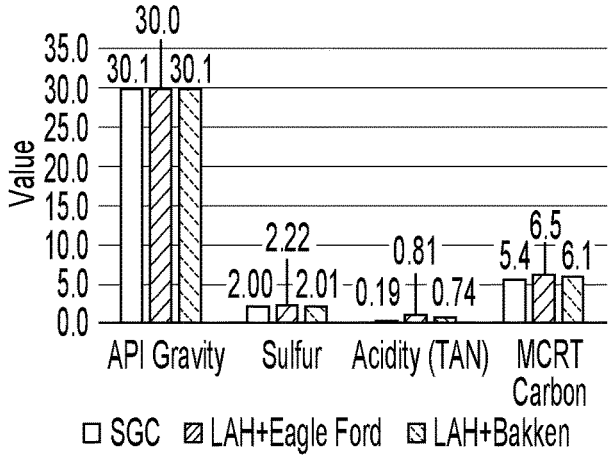
FIG. 13 and FIG. 14 show comparisons of medium sour crudes available from the Southern Green Canyon oilfield gas project with blended crudes in accordance with an aspect of an embodiment.
Figure 14:
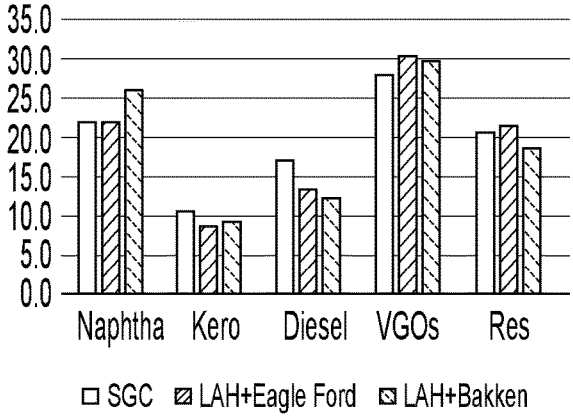

FIG. 13 and FIG. 14 show comparisons of medium sour crudes available from the Southern Green Canyon oilfield gas project with blended crudes utilizing light tight oil from Eagle Ford and utilizing light tight oil from Bakken with the neatbit.

As illustrated in FIG. 11 through FIG. 14, a blended crude having properties very similar to the properties of the medium sour crudes results.

The blended crude has qualities and characteristics similar to medium sour crudes and therefore has known refining characteristics for refining utilizing the same facilities at which medium sour crudes are refined.

Figure 15:
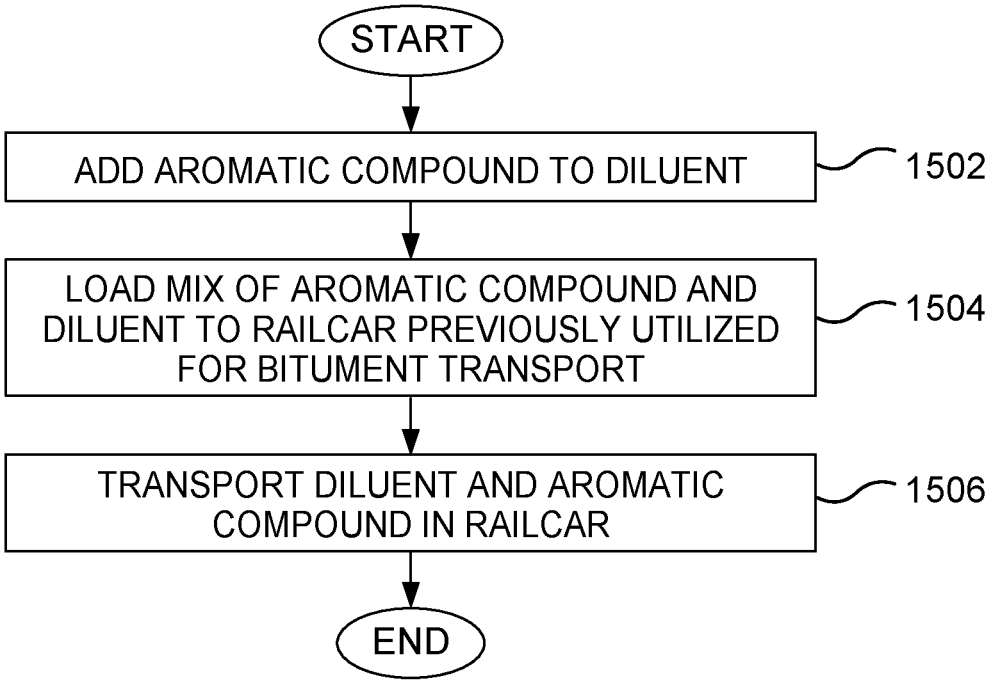
FIG. 15 is a flowchart showing a process for transporting diluent in accordance with yet another aspect of an embodiment.

After hauling neatbit to a destination by rail, such as the neatbit received at the destination at 1002 in FIG. 10, the railcar may be utilized for backhauling. A flowchart illustrating a process for transporting diluent is shown in FIG. 15. The process is shown and described generally herein and may include additional or fewer elements than shown and described. Parts of the process may be performed in a different order than shown or described herein.

The railcar may be heated, for example, by steaming to a temperature to lower the viscosity of the neatbit and facilitate offloading of the railcar. A small fraction of neatbit, however, remains in the railcar as a result of wall coating or from being trapped in a low point in the railcar. This small fraction is also referred to herein as residual oil. The neatbit remaining in the railcar after unloading may be, for example from about 2 bbl to about 4 bbl.

The neatbit that remains in the railcar is problematic because of the formation of asphaltenes that precipitate out. The emptied railcar with remaining neatbit may take a volume of about 600 bbl diluent, which can be backhauled to the origin site of the neatbit. A blend of greater than about 70%/30% bitumen/diluent, however, is unstable and asphaltene precipitation occurs. Asphaltene precipitation creates sludge deposits that may accumulate in the railcar, contaminate the condensate, or the following neatbit load. In addition, asphaltene particles may affect metering systems, valves, filters, pipes, and create issues when diluent is pumped out.

Rather than sending an empty railcar back or proceeding with expensive cleaning processes, an aromatic hydrocarbon is added to the diluent at 1502. Aromatic hydrocarbons such as toluene or xylenes, keep the asphaltenes in stable suspension, or even dissolve asphaltene. The aromatic stream can be added to the diluent tank to inhibit asphaltene precipitation, facilitating backhauling of diluents such as condensate, naphtha, or natural gasoline, and inhibiting asphaltene precipitation.

Available streams at the refinery that have high aromatic content may include, reformate or light reformate, light cyclic oil, or extract BTXs from the aromatic complex, which are mixtures of benzene, toluene, and the three xylene isomers. Any or all of these streams may be utilized. Light straight run naphtha (LSRN) may be sold by refineries as a diluent.

Experimental work was performed and confirmed that a diluent stream in an amount of about 2% by volume aromatic hydrocarbons to about 6% by volume is useful to suppress precipitation of asphaltenes. About 4% by volume aromatics blended with neatbit in any ratio is sufficient to suppress precipitation of asphaltenes.

The blended aromatic hydrocarbon and diluent is then loaded into the railcar previously utilized for bitumen transport at 1504 and transported or backhauled, thus transporting diluent back at 1506.

Table 2 shows properties of aromatic streams that may be utilized for blending with the diluent.

TABLE 2

| | API | Specific Gravity | Aromatic. Vol % | Sulfur |
|---|---|---|---|---|
| LCO | 25 | 0.904 | 40% | 0.70% |
| Lt Reformate | 45 | 0.802 | 60% | 0% |
| Reformate | 33 | 0.860 | 90% | 0% |
| LSRN | 85 | 0.654 | 0% | 0.00% |

Table 3 shows the properties of LSRN with different high aromatic streams.

TABLE 3

| LCO | Lt Refor-mate | Refor-mate | LSR | SG | API | Aromatic | Sulfur |
|---|---|---|---|---|---|---|---|
| 9.9% | | | 90.1% | 0.6784 | 77.08 | 4.0% | 0.095% |
| | 6.6% | | 93.4% | 0.6634 | 81.80 | 4.0% | 0.003% |
| | | 4.4% | 95.6% | 0.6627 | 82.03 | 4.0% | 0.003% |

Thus, the use of the aromatic hydrocarbons facilitates use of the railcars for backhauling diluent without excess cleaning to remove residual oil that may result in asphaltene production. Rather than utilizing pipeline facilities to transport the diluent recovered after transporting bitumen via pipeline, and therefore reducing the volume of bitumen that is transported by pipeline, railcars may be utilized for backhauling.

The described embodiments are to be considered in all respects only as illustrative and not restrictive. The scope of the claims should not be limited by the preferred embodiments set forth in the examples but should be given the broadest interpretation consistent with the description as a whole. All changes that come with meaning and range of equivalency of the claims are to be embraced within their scope.

The invention claimed is:

1. A process for producing diluent for use in a hydrocarbon recovery process, the process comprising:

heating a dilbit feed stream, the dilbit feed stream comprising hydrocarbons produced from a hydrocarbon reservoir and an added diluent added to the hydrocarbons to reduce the viscosity of the hydrocarbons for transport, wherein the dilbit feed stream is heated to a temperature of 350° C. or less with heat derived from process heat exchange;

fractionating the dilbit feed stream after the heating to produce a light fraction and a heavy fraction, the light fraction comprising the diluent, additional light hydrocarbons derived from the hydrocarbons, and sour water;

separating the sour water from a remainder of the light fraction; and stabilizing the remainder of the light fraction to provide recovered diluent and cooling the recovered diluent, wherein a volume of the recovered diluent is greater than a volume of the added diluent.

2. The process according to claim 1, wherein fractionating the dilbit feed stream comprises feeding the dilbit feed stream after heating to an upper portion of a diluent recovery unit.

3. The process according to claim 2, wherein fractionating the dilbit feed stream comprises introducing a stripping steam below a location at which the dilbit feed stream is introduced to the diluent recovery unit.

4. The process according to claim 3, comprising introducing the dilbit feed stream to a flash vessel prior to heating to provide an overhead from the flash vessel and liquids, and wherein heating the dilbit feed stream and fractionating comprises heating the liquids from the flash vessel and fractionating the liquids.

5. The process according to claim 4, wherein gas from an overhead of the flash vessel is introduced into the diluent recovery unit, between the location at which the dilbit feed stream is introduced and a location at which the stripping steam is introduced.

6. The process according to claim 1, comprising cooling the light fraction prior to separating the sour water.

7. The process according to claim 1, comprising condensing overhead gases from stabilizing, separating out remaining produced gas, and utilizing the remaining produced gas as fuel in the heating of the dilbit feed stream.

8. The process according to claim 1, comprising cooling recovered diluent from stabilizing for use in hydrocarbon transport.

9. The process according to claim 1, comprising recovering heat from the heavy fraction after fractionating.

10. The process according to claim 9, comprising loading the heavy fraction to a railcar for transportation.

11. The process according to claim 1, wherein the heavy fraction has an °API of less than 10.

12. The process according to claim 1, wherein the heavy fraction has an °API of less than 8.0.

13. A system for producing diluent for use in a hydrocarbon recovery process, the system comprising:

a heater for heating a dilbit feed stream using process heat exchange, the dilbit feed stream including hydrocarbons produced from a hydrocarbon reservoir and an added diluent added to the hydrocarbons to reduce the viscosity of the hydrocarbons for transport, wherein the heater is configured to heat the dilbit feed stream to a temperature of 350° C. or less;

a diluent recovery unity for fractionating the dilbit feed stream after the heating to produce a light fraction and a heavy fraction, the light fraction comprising the diluent, additional light hydrocarbons derived from the hydrocarbons, and sour water;

a separator for separating the sour water from a remainder of the light fraction; and a stabilizer for stabilizing the remainder of the light fraction to provide recovered diluent and cooling the recovered diluent, wherein a volume of the recovered diluent is greater than a volume of the added diluent.

14. The system according to claim 13, comprising a flash vessel for flashing the dilbit feed stream prior to introducing to the heater, to provide an overhead from the flash vessel and liquids.

15. The system according to claim 13, comprising a condenser for condensing overhead gases from the stabilizer to separate out remaining produced gas.

16. The system according to claim 15, wherein the produced gas from the condenser is utilized as fuel in the heater.

17. The system according to claim 13, comprising a heavy fraction tank for storing the heavy fraction prior to loading to a railcar.

18. The system according to claim 13, comprising a diluent tank for storing the diluent.

19. A process for providing crude oil for refining comprising blending the heavy fraction produced by the process according to claim 1 with a light tight oil to provide a blended crude having properties suitable for refining at a medium sour crude oil refinery.

20. A process for transporting the diluent produced by the process according to claim 1, comprising:

adding an aromatic hydrocarbon to the diluent;

loading the mix of the aromatic hydrocarbon and diluent to a railcar having residual oil therein from hydrocarbon transportation; and transporting the diluent and the aromatic hydrocarbon in the railcar.

* * * * *